US009947199B2

(12) United States Patent
Mittal et al.

(10) Patent No.: US 9,947,199 B2
(45) Date of Patent: Apr. 17, 2018

(54) COLLABORATIVE THREAT ASSESSMENT

(71) Applicant: International Business Machines Corporation, Armonk, NY (US)

(72) Inventors: Vani Mittal, Bangalore (IN); Anbumunee Ponniah, Bangalore (IN)

(73) Assignee: International Business Machines Corporation, Armonk, NY (US)

( * ) Notice: Subject to any disclaimer, the term of this patent is extended or adjusted under 35 U.S.C. 154(b) by 252 days.

(21) Appl. No.: 14/309,020

(22) Filed: Jun. 19, 2014

(65) Prior Publication Data

US 2015/0371518 A1 Dec. 24, 2015

(51) Int. Cl.
*G08B 21/02* (2006.01)
*G08B 21/18* (2006.01)

(52) U.S. Cl.
CPC ..... *G08B 21/02* (2013.01); *G08B 21/182* (2013.01)

(58) Field of Classification Search
CPC ..... G08B 21/02; G08B 21/182
See application file for complete search history.

(56) References Cited

U.S. PATENT DOCUMENTS 8,669,864 B1 * 3/2014 Tedesco ..... G08B 21/0453 340/539.12
9,058,734 B2 6/2015 Xiao et al.
9,658,068 B2 5/2017 Troxler
9,685,067 B2 6/2017 Shaw
2004/0119591 A1 6/2004 Peeters
2011/0046920 A1 2/2011 Amis
2011/0130112 A1 * 6/2011 Saigh ..... H04M 1/7253 455/404.1
2011/0181408 A1 * 7/2011 Greenis ..... G08B 27/00 340/539.1
2012/0268269 A1 10/2012 Doyle
2013/0183924 A1 * 7/2013 Saigh ..... H04W 4/025 455/404.2
2014/0118143 A1 * 5/2014 Monacos ..... G08B 21/02 340/539.13
2015/0199895 A1 * 7/2015 Hilliges ..... G08B 25/016 340/425.5

OTHER PUBLICATIONS

Hanlon, Mike, "New security alert tracking system monitors the vital signs of all employees and reports wirelessly", Copyright Gizmag 2003-2014, Mar. 8, 2007, <http://www.gizmag.com/go/6961/>.

(Continued)

*Primary Examiner* — James Yang
(74) *Attorney, Agent, or Firm* — Isaac J. Gooshaw

(57) ABSTRACT

One or more processors determine whether a hazard that is detected by a first mobile device exists based on data received from at least one second mobile device. The second mobile device is within a proximity to the first mobile device, which is determined based on a type of the hazard. One or more processors respond to a determination that the hazard does exist by determining a course of action. The course of action is configured for a user based on at least one attribute of the user. One or more processors send the course of action to the first mobile device.

20 Claims, 4 Drawing Sheets

(56) References Cited

OTHER PUBLICATIONS

Lakshane,Rohini "Mobile apps for personal safety", Jan. 3, 2013, Copyright © 2014 TECH2.COM, <http://tech.firstpost.com/news-analysis/mobile-apps-for-personal-safety-64274.html>.
Ramalingam et al., "Personal Safety Triggering System on Android Mobile Platform", 19 pages, International Journal of Network Security & Its Applications (IJNSA), Jul. 2012.
SecuraTrac—In the News—Recent News on State of the Art GPS Tracking for Kids and, pp. 1-2, SecuraTrac, Dec. 19, 2012, <http://www.securatrac.com/news/>.
Paul et al., "Smarter Cities Series: Understanding the IBM Approach to Public Safety", © Copyright IBM Corp. 2011, pp. 1-20, This document, REDP-4738-00, was created or updated on Dec. 1, 2011.

* cited by examiner

COLLABORATIVE THREAT ASSESSMENT

BACKGROUND OF THE INVENTION

The present invention relates generally to the field of safety, and more particularly to providing real-time feedback to users.

For many smartphone users, their smartphones have become a near constant companion that travels with them wherever they go. Instauration of such mobile devices has given birth too many innovative technologies. Further, exchanging information globally using such devices has become more prominent. Smart phones have provided new dimensions in utility to the users of mobile phones. The hardware, operations systems and the applications of smartphones have advanced significantly and now allow smartphones to wield computing power that was previously unimaginable. Apart from basic functionality such as messaging, calling and cameras, smart phones have evolved to incorporate many of the functionalities of a personal computer.

A fundamental responsibility of public safety officials is to ensure the safety of individuals and to protect their assets. Therefore, many such individuals are investing in and applying new technologies to reduce crime and to improve emergency response.

SUMMARY

Embodiments of the present invention provide a method, system, and program product to recommend a course of action to a user. One or more processors determine whether a hazard that is detected by a first mobile device exists based, at least in part, on data received from at least one second mobile device. The at least one second mobile device is within a proximity to the first mobile device. The proximity is determined based, at least in part, on a type of the hazard. One or more processors respond to a determination that the hazard does exist by determining a course of action. The course of action is configured for a user based, at least in part, on at least one attribute of the user. One or more processors send the course of action to the first mobile device.

DETAILED DESCRIPTION

A hazard, as used herein, refers to a state of being (e.g., a situation, an environment, a scenario), which has been determined to pose a potential undesired result for a user, e.g., a danger, peril, risk, threat or menace posed to the user, which constitutes an undesirable state of being for the user.

Embodiments of the present invention recognize that what is considered to be a hazard varies according to each person. Embodiments of the present invention recognize that, based on the definition of a hazard, various sources of data are required in order to make assessments of potential hazards. Embodiments of the present invention provide a personalized assessment of potential hazards that can assist individuals in the avoidance of those hazards. Embodiments of the present invention recognize that not all users are privy to the same information and, as such, their respective assessment of a hazard varies accordingly. An embodiment of the present invention provides a solution for hazard assessment that is highly scalable to encompass a wide range of individuals. Certain embodiments of the present invention provide notification to a user of a certain hazard if a threshold related to that hazard has been reached. Embodiments of the present invention recognize the assessment of a hazard on an individual level using the computing ability of a mobile device of that individual. Embodiments of the present invention recognize confirming the presence of a hazard when a mobile device of an individual has indicated the existence of a hazard. Embodiments of the present invention recognize calibrating sensors based on a biological history of an individual. Embodiments of the present invention recognize the use of a personal profile and historical information about the individual to reduce the number of false-positive identifications of a hazard. Embodiments of the present invention recognize that verification of a hazard requires only a signal of confirmation from other nearby mobile devices and does not require sensor data corresponding to other individuals. Embodiments of the present invention recognize that such confirmation requires the location of the other nearby mobile devices. Certain embodiments of the present invention provide a user with an alternative action to mitigate a potential hazard from being realized. Embodiments of the present invention provide a dynamic determination of a proximity based on the potential severity of a hazard.

The present invention will now be described in detail with reference to the Figures.

In general, mobile device 121 is included as part of mobile devices 120. However, for the sake of clarity and to provide ease of understanding in the following description, mobile device 121 is shown and described as existing separately from mobile devices 120.

Figure 1:
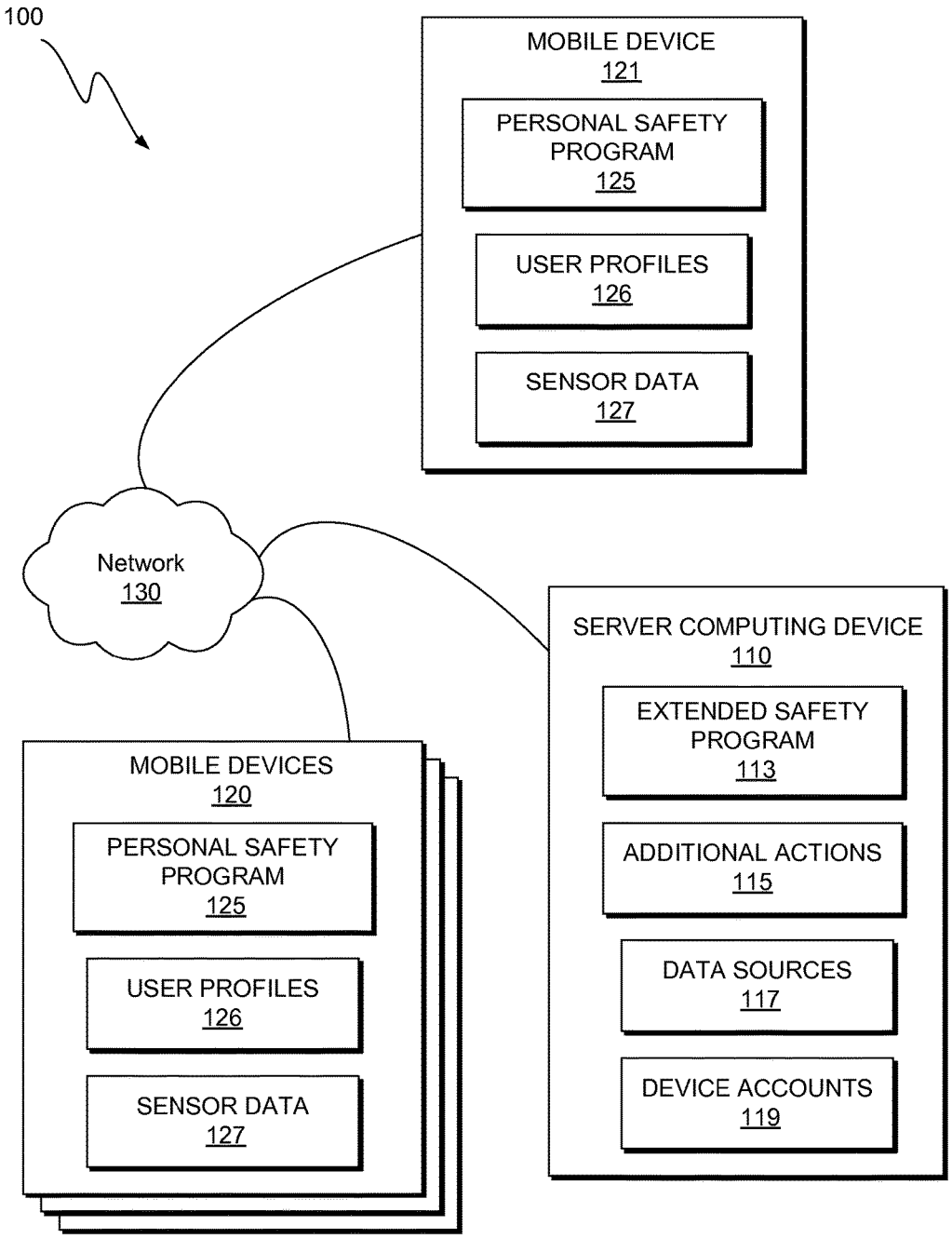
FIG. 1 is a functional block diagram illustrating a dynamic hazard generating environment, in accordance with an embodiment of the present invention.

FIG. 1 is a functional block diagram illustrating a dynamic hazard generating environment, generally designated 100, in accordance with one embodiment of the present disclosure. Dynamic hazard generating environment 100 includes server computing device 110, mobile device 121 and mobile devices 120 connected over network 130. Server computing device 110 includes extended safety program 113, additional actions 115, data sources 117 and device accounts 119. Mobile devices 120 represent a plurality of mobile devices. As such, each respective mobile device included in mobile devices 120 respectively includes personal safety program 125, user profile 126, and sensor data 127. Mobile device 121 also includes personal safety program 125, user profile 126, and sensor data 127. Both mobile device 121 and mobile devices 120 respectively include sensors, which, for simplicity, are not shown in the Figures.

In some embodiments of the present invention, server computing device 110 is a computing device that can be a standalone device, a server, a laptop computer, a tablet computer, a netbook computer, a personal computer (PC), or a desktop computer. In another embodiment, server computing device 110 represents a computing system utilizing clustered computers and components to act as a single pool of seamless resources. In general, server computing device 110 can be any computing device or a combination of devices with access to mobile device 121, mobile devices 120, extended safety program 113, additional actions 115, data sources 117 and device accounts 119 and is capable of executing extended safety program 113. Server computing device 110 may include internal and external hardware components, as depicted and described in further detail with respect to FIG. 4, in accordance with an embodiment of the present invention.

In this embodiment, extended safety program 113, additional actions 115, data sources 117 and device accounts 119 are stored on server computing device 110. In this embodiment, personal safety program 125, user profile 126, and sensor data 127 are respectively stored on mobile device 121 and mobile devices 120. In some embodiments one or more of extended personal safety program 125, user profile 126, and sensor data 127 are stored externally from mobile device 121 and mobile devices 120 and are accessed through a communication network, such as network 130. In some embodiments one or more of extended safety program 113, additional actions 115, data sources 117 and device accounts 119 are stored externally from computing device 110 and are accessed through a communication network, such as network 130. Network 130 can be, for example, a local area network (LAN), a wide area network (WAN) such as the Internet, or a combination of the two, and may include wired, wireless, fiber optic or any other connection known in the art. In general, network 130 can be any combination of connections and protocols that will support communications between server computing device 110, mobile devices 120, mobile device 121, personal safety program 125, user profiles 116, data sources 117, personal safety program 125, user profile 126, and sensor data 127, in accordance with an embodiment of the present invention.

In some embodiments of the present invention, mobile device 121 and mobile devices 120 are, for example, computing devices that can be smartphones, laptop computers, tablet computers, netbook computers, personal computers (PCs), desktop computers that are connected to network 130, and the like. In another embodiment, mobile device 121 and mobile devices 120 represent at least a part of a computing system utilizing clustered computers and components to act as a single pool of seamless resources. In general, mobile device 121 and mobile devices 120 respectively include personal safety program 125, user profile 126, and sensor data 127. In general, mobile device 121 and mobile devices 120 can be any computing device or a combination of devices with access to personal safety program 125, user profile 126, and sensor data 127 and are capable of executing personal safety program 125. Mobile device 121 and mobile devices 120 may respectively include internal and external hardware components, as depicted and described in further detail with respect to FIG. 4, in accordance with an embodiment of the present invention.

In an embodiment, personal safety program 125 uses a set of customized rules for a given user, which are created by the user and included in user profiles 126, to generate a set of hazard thresholds and parameters for a particular user, which are included as part of user profiles 126. User profiles 126 is also based on historic measurements from sensors of mobile device 121, which are associated with time of day and location. This information is used by personal safety program 125 to extrapolate a baseline, i.e., what is "normal", biological sensor readings for the individual for a given location and time. In accordance with various embodiments, these biological sensor readings include data such as heart rate, blood pressure, blood oxygen levels, sugar levels, level of perspiration etc., or combinations thereof. Personal safety program 125 accesses sensor data included in sensor data 127 and analyzes that data using the generated hazard thresholds and parameters to determine whether or not a hazard exists. The respective sensor data included in sensor data 127 is generated by one or more sensors that are in communication with mobile device 121 or mobile devices 120, further respectively. In general, a hazard is deemed to exist if one of the thresholds has been reached or exceeded. If a threshold has been exceeded, then personal safety program 125 sends a message indicating the hazard to extended safety program 113, which is executing on server computing device 110. For example, personal safety program 125 executing on mobile device 121 determines that a threshold has been exceeded. In response to that determination, the personal safety program 125 executing on mobile device 121 sends a message to extended safety program 113 indicating the hazard.

In an embodiment, device accounts 119 included details regarding the respective users of mobile device 121 and mobile devices 120. This information includes respective medical histories and respective sets of rules for the user of mobile device 121 and the users of mobile devices 120. These rules include a variety of variables based on the specific user for which a recommended course of action will be determined.

In an embodiment, extended safety program 113 responds to the reception of the message indicating the hazard by accessing device accounts 119 and locating one or more mobile devices included as part of mobile device 120 that are within a proximity of mobile device 121. Extended safety program 113 determines the proximity to be used based on the potential severity of the hazard. The proximity is determined dynamically and is proportional to the nature of hazard, time of day, location and the personal profile, included in user profiles 126, of the user of mobile device 121. In some embodiments, for each event, location, time and weather combination, there are relative factors of increase or decrease of proximity. For example, a fire event at a stadium could be seen from 100 meters whereas an incident at a privately owned home could be witnessed only within the same room (hence proximity is minimum width of a room). In another example, a "fear" event reported by mobile device 121, which is in a house at 8 PM, in a sparsely populated neighborhood, would require proximity range to be that of minimum width of a room in the house. Whereas a fire event reported by a mobile device at 8 PM in an open stadium would have a range of proximity equal to the width of the stadium. Extended safety program 113 sends a signal to the identified one or more mobile devices 120 that are within that proximity and analyses the replies from the personal safety program 125 executing on those mobile devices 120. Based on a result of the analysis, extended safety program 113 determines whether the existence of the hazard has been verified. If the hazard is verified, extended safety program 113 accesses additional actions 115, data sources 117, and device accounts 119, and determines which respective action or actions are appropriate for the users of mobile devices 120 and mobile device 121. Extended safety program 113 then sends messages to the users of mobile devices 120 and mobile device 121 that indicate their respective recommended courses of action.

Personal safety program 125 presents the recommended course of action, received from extended safety program 113, to the given user to assist the user in avoidance of the hazard. In general, the combined functionality of personal safety program 125 and extended safety program 113 includes the capability to provide a customized assessment of potential hazards for an individual based on the personal attributes, such as training, mental and physical abilities and characteristics, and preferences of that user, and on data mined from data sources 117. The result is identification of a hazard, or a potential hazard, based on data from a single user that is verified by the data of a larger group of users. Such an identification of a hazard, based on the data of a single user, reduces the computational demands of hazard identification. In addition, the verification of the hazards existence, or potential existence, based on the data of a group of users, reduces the number of false-positive identifications of hazards.

In this embodiment, personal safety program 125 has the capability to recommend a course of action for a user based on the information included in user profiles 126 and sensor data 127. However, in this embodiment, these courses of action are limited to a number of preprogrammed courses of action, such as "go home", "call hospital" or "run". Conversely, extended safety program 113 includes the capability to provide a greater variety of responses that are based on information that is included as part of data sources 117. For example, based on an analysis of the responses from mobile devices 120, extended safety program 113 confirms that a fire has broken out in a building. Personal safety program 115 has already communicated an initial course of action to the respective user of mobile device 121. That course of action including a message of "Fire, exit the building". However, based on an analysis of the buildings structure and the number of individuals located near the front stairwell of the building, extended safety program 113 sends a message to the user to "Exit the building via rear stairwell".

In exemplary embodiments, user profiles 126 includes profile information for users that are registered with personal safety program 125. For each respective user, such a profile includes rules which indicate which situations, objects or individuals are considered to present a hazard to that user. To determine whether a particular situation indicates the possible existence of a hazard, user profiles 126, includes a normalized score which, in some embodiments, falls under different threshold ranges. For ease of understanding, these ranges are placed in order of severity and assigned colors—green, yellow, orange, and red; with green representing no hazard and red representing imminent hazard. In some embodiments, different actions are configured for different ranges. For example, if the hazard level is yellow, then mobile device 121 continuously monitors sensory input without taking any action. However, if the range is red, then immediate action needs to be taken, such as signaling extended safety program 113. In one embodiment, among the pre-defined actions of mobile device 121, one of the actions is to turn on peripheral devices like audio recording, camera etc. to collect data in the case of a hazard materializing, i.e., affecting the user. Such a response is based on the level of hazard determined as mentioned above, e.g., a hazard in the red range. In some scenarios, such actions reduce the power requirements and the amount of data to be analyzed since peripheral devices are activated only as needed.

In some embodiments, dynamic proximity and different levels of hazard ranges reduces the number of false negatives, i.e. situations where personal safety program 125 indicates a high potential for a hazard to exist but extended safety program 113 determines a low potential for a hazard to exist. In certain scenarios, the input from the nearby devices, e.g., mobile devices 120, is given a higher priority; while in other cases a determination by personal safety program 125 of mobile device 121 is given priority. For example, in one scenario, a user of mobile device 121 and users of nearby mobile devices 120 are all are in an elevator. The user of mobile device 121 is afraid of confined spaces. Conversely, the respective users of nearby mobile devices 120 are not afraid of confined spaces. As such, the nearby mobile devices 120 give a low hazard score while riding in the elevator while mobile device 121 gives a high hazard score.

In some embodiments, personal safety program 125 performs a partial validation of a potential hazard based on information received from nearby mobile devices 120. For example, a user is a young woman sitting in a crowded restaurant waiting for a friend to arrive. The user slowly becomes agitated as she has been waiting for her friend for the past 30 minutes. The sensor on her mobile device 121 detects a high heart rate. Based on details included in her user profile and the signals from the sensors included in mobile device 121, personal safety program 125, of mobile device 121, generates a medium hazard score and determines to request hazard ratings from nearby mobile devices 120 in proximity of mobile device 121 for further validation of the potential hazard. Mobile devices 120 within the proximity return a low hazard score to mobile device 121. Since the density of mobile devices 120 in proximity of mobile device 121 is high (being a crowded restaurant), information from them is given a high weightage. As such, personal safety program 125, of mobile device 121 determines that the combined hazard score is medium and does not signal extended safety program 113 for validation of the potential hazard. In addition, personal safety program 125 continues to re-evaluate the score at regular intervals until the score drops down to low or increases to high. The friend arrives and the sensor signals of the user return to normal. The user leaves the restaurant and is on the way to the nearby bus stop to catch a bus. The user notices an individual following them and becomes worried for their safety. As such, personal safety program 125, of mobile device 121 detects the change in sensor signals and determines to request hazard ratings from mobile devices 120 in proximity to mobile device 121. The area is almost deserted and based on the time 1 AM (environmental information), personal safety program 125 assigns a low weight to any information received from mobile devices 120. As such, based on user profile, sensor signals and the environmental information, personal safety program 125 determines that the hazard score is high and takes action, as configured for such a scenario.

In some cases, the rules define a hazard as a combination of specific situations, objects or individuals. In some embodiments, a rule can dictate a course of action, which is often specified by the user as a course of action to be taken in response to a rule being met. For example, a rule is configured by a user such that if the heart rate of the user is determined to be below a threshold, then personal safety program 125 is to send a message to extended safety program 113 indicating a potential hazard. In this particular example, the heart rate of the user is based on data included as part of sensor data 127. The sensor providing that heart rate data is monitoring the heart rate of the user of mobile device 121. As such, when the heart rate of the user drops below the threshold, extended safety program 113 sends the user a message with a preprogrammed course of action that is specified by the rule. In some embodiments, extended safety program 113 has the capability of executing certain actions independent of the user. For example, in continuation of the previous example, extended safety program 113 dials an emergency line for the nearest health center and indicates the location of the user and that the user is having heart failure. In another example, extended safety program 113 sends an alert message to a second party, e.g., a family member of the user, an authority figure, or an agency such as the police department, fire department or a hospital.

The rules included in user profiles 126 can include spatial limitations. For example, if the situations, objects or individuals are within a proximity to the individual, then the rule dictates that personal safety program 125 issue an alert message to inform the user of the potential hazard. For example, a user does not enjoy the rain. As such, the user can create a rule that warns of the potential of rain, i.e., the rule includes thresholds for humidity and barometric pressure. In such a case, mobile device 121 and mobile devices 120 respectively include sensors to monitor humidity and barometric pressure and that data is included as part of sensor data 127. In general, sensor data 127 is a repository for sensor data respectively generated by the sensors of mobile device 121 and mobile devices 120.

In some embodiments, personal safety program 125 monitors the information included in sensor data 127 for patterns and calibrates sensors, included in mobile devices 120 and mobile device 121, accordingly. For example, mobile device 121 includes a sensor to detect the ambient temperature surrounding the user, which was calibrated at a factory. However, the user prefers to keep mobile device 121 in their pocket. The user of mobile device 121 has created a rule to warn them of excessive heat conditions outside, i.e., high ambient temperatures. However, because the user keeps mobile device 121 in their pocket the temperature readings are no longer representative of the actual ambient temperature. Based on sensor readings being in a near constant state that indicates high ambient temperatures, personal safety program 125 recalibrates the sensor to more accurately reflect the true ambient temperature. In some embodiments, personal safety program 125 accesses data sources 117 as part of calibrating a sensor included in mobile devices 120. For example, in continuation with the previous example, personal safety program 125 accesses 117 and determines the actual temperature around the user of device 121 and uses that information to recalibrate the sensor. In another example, personal safety program 125 determines that the user of mobile device 121 experiences an increased heart rate at 6 am every day. In response, in one embodiment, personal safety program 125 recalibrates the sensor to indicate a normal readout during that time period. In another example, personal safety program 125 modifies a rule to disregard the increased heart rate during that time period. In some situations and embodiments, such rule changes and sensor recalibrations reduces the number of false-positive identifications of hazards by personal safety program 125.

In exemplary embodiments, data sources 117 is a large body of data that is accessed by extended safety program 113 to determine a recommended course of action of the respective users of mobile device 121 and mobile devices 120. Data sources 117 includes data from sources such as the internet. Data sources 117 can also include information such as the global positioning system (GPS) locations of various objects, such as mobile device 121 and mobile devices 120, predicted and confirmed weather events, the location and inner structure of buildings, transit stations, etc. In the embodiment described in the discussion of FIG. 3, data sources 117 further includes data from blogs and social media sites, which includes the opinions of people regarding a plethora of subjects.

In some embodiments, data sources 117 includes public databases. For example, judicially or administratively generated records and reports for an area or an individual, and property records that indicate a resident of a housing structure. In some embodiments, data sources 117 includes semi-public and non-public, i.e., private, data sources. For example, data sources 117 may include data related to borders of properties, building ingress and egress, public and non-public buildings or structures, venues such as restaurants, nightclubs, and stadiums, location data of individuals, and events with controlled or limited access (such as events that require tickets for admission). In some embodiments, data sources 117 includes public emergency alert services such as inclement weather warnings, amber alerts and air quality or allergen alerts. In some embodiments, data sources 117 includes GPS data originating from individuals (via carried/worn electronics like smartphones, tablets, laptops, watches, glasses, etc.), non-publicly owned vehicles, and public transportation such as airplanes, trains, buses, subways, ferries and taxies. In some embodiments, data sources 117 includes static geo-location information for places of interest and concern, like stadiums, entertainment establishments, and the like. In some embodiments, data sources 117 includes data that can add context to another piece of data to increase or decrease the severity of a given hazard. For example, a potential hazard posed to an individual may be different depending on a mode of transit being utilized at that particular moment. In this case, a potential hazard for an individual that is walking can be different than a potential hazard for an individual in a moving automobile.

Figure 2:
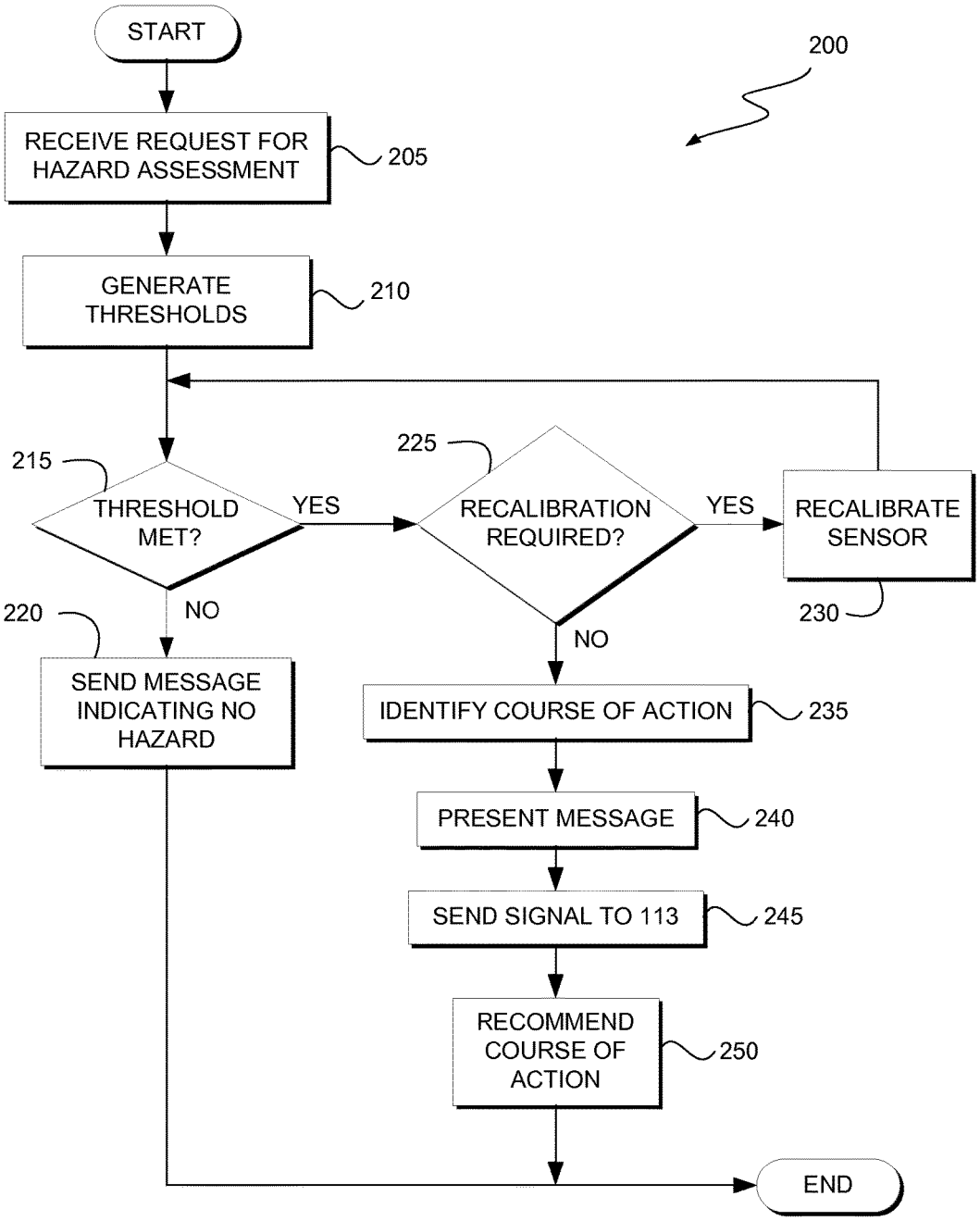
FIG. 2 is a flowchart illustrating operational processes of a personal safety program, executing on a mobile device within the environment of FIG. 1, in accordance with an embodiment of the present invention.

FIG. 2 is a flowchart, 200, illustrating operational processes of personal safety program 125, executing on a mobile device within the environment of FIG. 1, in accordance with an embodiment of the present disclosure.

For simplicity, the discussion of FIG. 2 will be approached from the perspective of personal safety program 125 executing on mobile device 121.

In process 205, personal safety program 125 of mobile device 121 receives a request to begin hazard assessment. The exact circumstances under which personal safety program 125 receives a request for a hazard assessment can vary in certain embodiments. In some embodiments and scenarios, a user submits such a request for a hazard assessment. In some embodiments and scenarios, such a request for hazard assessment is automatically generated and received by personal safety program 125 in response to user input that does not directly constitute a request for a hazard assessment. For example, a user enters in a planned destination into their mobile device. Personal safety program 125 identifies the destination as well as the route to be taken to reach that destination. Based on the route and destination, personal safety program 125 generates a request for a hazard assessment, which is subsequently received by personal safety program 125 and processed. In yet another scenario, personal safety program 125 is monitoring the information being stored as part of sensor data 127. Personal safety program 125 identifies a pattern of sensor data that is inconsistent with the historical sensor data included in sensor data 127. In response, personal safety program 125 generates a request for hazard assessment which is received and processed by personal safety program 125.

In process 210, personal safety program 125 generates a set of thresholds to be applied to data included as part of sensor data 127 that is received from the sensors of mobile device 121. To generate a set of thresholds to be applied to data included in sensor data 127, personal safety program 125 accesses the rules included in user profiles 126, of mobile device 121. In general, not all rules included in user profiles 126 are applied continuously. The rules that are to be applied for a given scenario are often time, date, location or sensor data sensitive. For example, if a user is indoors, then a rule pertaining to inclement weather is not used. Further, if a rule exists but there is insufficient information included in sensor data 127 for the rule to function, then personal safety program 125 does not use that rule to generate thresholds. For example, a rule specifies heart rate as a variable but the heart rate sensor is not functioning. As such, personal safety program 125 does not use that rule to generate thresholds. Personal safety program 125 compares these rules to the information included in sensor data 127 and identifies which rules should be used to generate thresholds. Personal safety program 125 identifies the acceptable ranges that are associated with the various types of sensor data that are used in those rules and generates thresholds based on one or both of the maximum and minimum of those ranges.

In decision process 215, personal safety program 125 determines whether the information included in sensor data 127 indicates that a threshold has been met. In this embodiment, personal safety program 125 monitors the data streaming from the sensors included in mobile device 121. If personal safety program 125 determines that the information included in sensor data 127 indicates that a threshold has not been met (decision process 215, NO branch), then personal safety program proceeds to process 220, and generates a message indicating that there is no recommended course of action, which is presented to the user of mobile device 121. If personal safety program 125 determines that the information included in sensor data 127 does indicate that a threshold has been met (decision process 215, YES branch), then personal safety program proceeds to decision process 225.

In decision process 225, personal safety program 125 determines whether the information included in sensor data 127 indicates that a recalibration of the sensor is required. In this embodiment, personal safety program 125 monitors the data streaming from the sensors included in mobile device 121 and determines that a recalibration of the sensor is required if the data from the sensor meets or exceeds the threshold in excess of a predetermined period of time or in excess of a predetermined number of occurrences. For example, a sensor indicates that the user has a body temperature of 42 degrees Celsius and that this temperature has been maintained with a variation of only 1 degree for three days. As a result, personal safety program 125 determines that the sensor requires calibration. If personal safety program 125 determines that the information included in sensor data 127 indicates that a recalibration of the sensor is required (decision process 225, YES branch), then personal safety program proceeds to recalibrate the sensor, in process 230, and continues to decision process 215.

If personal safety program 125 determines that the information included in sensor data 127 indicates that a recalibration of the sensor is not required (decision process 225, NO branch), then personal safety program identifies a course of action to be recommended to the user, in process 235. The course of action is identified based on the threshold that was met or exceeded and a preset course of action included as part of user profiles 126. For example, the threshold that was exceeded was generated based on a rule pertaining to pollen content of the air. The pollen content exceeded the maximum threshold for pollen content. As such, personal safety program 125 identifies the rule pertaining to pollen content and preset recommended course of action "A" that is associated with the rule.

In process 240, personal safety program 125 generates and presents a message to the user that includes the preset course of action, e.g., preset recommended course of action "A". In process 245, personal safety program 125 sends a signal to extended safety program 113 indicating the potential hazard and includes the location of mobile device 121, e.g., a global positioning system (GPS) location of mobile device 121.

In process 250, personal safety program 125 updates the recommended course of action based on whether extended safety program 113 has confirmed the hazard. If safety program 113 has confirmed the hazard, then safety program 113 sends an updated course of action to mobile device 121 and personal safety program 125 displays the updated course of action. If safety program 113 has been unable to confirm the hazard, then safety program 113 sends a signal to mobile device 121 to indicate this. In response, personal safety program 125 displays a message to the user of mobile device 121 indicating that the hazard was not confirmed. The user then determines whether or not to follow the preset recommended course of action.

In certain embodiments, extended safety program 113 recommends an alternative course of action for the user, such that the potential hazard is (at least partially) avoided or the alternative action mitigates the chances of a potential hazard from being realized. For example, such a course of action can include an alternate route of transit to be used by the first user, an alternate venue to be attended by the first user, or an alternate event to be attended by the first user etc. In some embodiments, the alternate actions that are recommended are pre-programmed. In some embodiments, extended safety program 113 includes programming and functionality to: access user profiles 126 and sensor data 127, identify a variable of a rule that is modifiable via user action, and suggest a course of action that will result in the needed change such that the potential hazard is (at least partially) avoided or its chance of existing is mitigated. In some embodiments, such functionality is based on searches using a mapping program, a scheduling program or other like programs that are capable of determining alternative routes, venues and events for the user.

Figure 3:
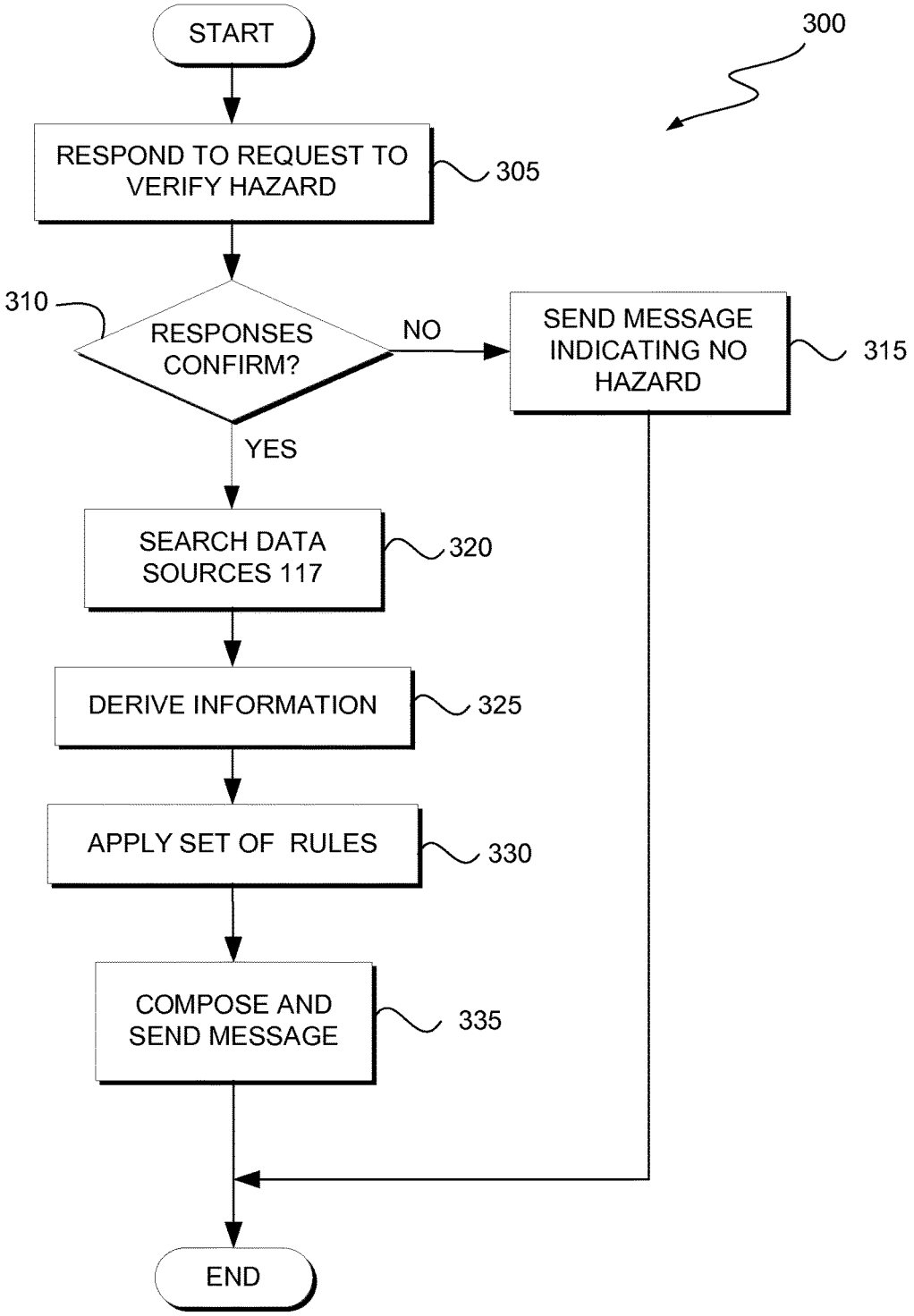
FIG. 3 is a flowchart illustrating operational processes of an extended safety program, executing on a server computing device within the environment of FIG. 1, in accordance with an embodiment of the present invention.

FIG. 3 is a flowchart, 300, illustrating operational processes of extended safety program 113, executing on server computing device 110 within the environment of FIG. 1, in accordance with an embodiment of the present disclosure.

In process 305, extended safety program 113 responds to a request to verify a potential hazard by contacting mobile devices 120. For example, extended safety program 113 receives a request to verify a potential hazard from mobile device 121. Extended safety program 113 accesses device accounts 119 and identifies one or more mobile devices 120 that are within a proximity to mobile device 121. Extended safety program 113 sends a message to the one or more mobile devices 120 that are within the proximity. The message includes a request for verification of the potential hazard identified by mobile device 121.

In decision process 310, extended safety program 113 determines whether the responses from the one or more mobile devices 120 confirm the existence of the hazard. In general, the responses from the one or more mobile devices 120 are in a positive or negative format, e.g., "yes" or "no". As such, extended safety program 113 tallies the number of positive or negative responses to determine whether there is a statistical confirmation of the potential hazard. If extended safety program 113 determines that the responses from the one or more mobile devices 120 do not confirm the existence of the hazard (decision process 310, NO branch), then extended safety program 113 sends a message to mobile device 121 indicating that no hazard was identified, in process 315, i.e., that safety program 113 was unable to confirm the existence of the hazard. If extended safety program 113 determines that the responses from the one or more mobile devices 120 do confirm the existence of the hazard (decision process 310, YES branch), then extended safety program 113 begins determining recommended courses of action by searching data sources 117, in process 320. The recommended courses of action being determined by extended safety program 113 include an updated course of action for the user of mobile device 121 as well as respective recommended courses of action for the users of mobile devices 120 that are within the proximity to mobile device 121.

To begin determining recommended courses of action, in step 320, extended safety program 113 searches data sources 117 for data to be used in the hazard assessment. Extended safety program 113 searches a variety of data sources, such as the data sources included in data sources 117, and collects real-time information by parsing the data retrieved from data sources 117. In certain embodiments, one or more aggregation techniques are applied to the collected data in order to yield a more statistically valid set of data, e.g., outlier pieces of data are removed from the collected data set. The parsing yields specific types of data that can be used as variables for determining recommended courses of action for users in the event that a hazard is confirmed. For example, specific types of information include information such as names, addresses, dates, routes etc. In some scenarios, extended safety program 113 also identifies the opinion of at least one user or the opinions of a plurality of users regarding possible recommended courses of action for users. For example, in building X, hallway Y on floor Z is undergoing renovation and includes carts filled with debris, tools and construction materials. A user has entered a comment about that buildings cluttered hallway indicating that the renovation has hampered passage. As such, extended safety program 113 does not recommend use of hallway Y as a route of egress from building X, in the event that a hazard is confirmed.

In some embodiments and scenarios the parsing also identifies the plurality of opinions of users. In some embodiments and scenarios the opinions of the plurality of users regarding the subjects are assessed to determine a consensus of those opinions, which is then used to represent the opinions of the plurality of users. In some scenarios, such a consensus includes the number of opinions that are positive and the number that are negative etc. For example, the opinions for a particular roadway during rush hour are 60% positive, 33% negative and 7% neutral. As such, the overall consensus is that the particular roadway during rush hour is held in a positive opinion, but one in three patrons experienced difficulty traversing that particular roadway during rush hour. Extended safety program 113 applies a statistical analysis to a model of traffic flow in the event that a hazard is confirmed during rush hour to determine whether to recommend the use of that roadway as a route of travel. Such an analysis takes into account not only the opinions of the users but also the predicted increase in traffic volume if extended safety program 113 were to recommend the use of that roadway as a route of travel in the event that a hazard is confirmed during rush hour.

In process 325, extended safety program 113 derives information based on the data retrieved from data sources 117. The derived information may include an identification of an individual, a planned destination for an individual, and an opinion shared by a group of users for, for example, a particular location, the weather, an object, or a concert. A derived information is often not directly associated with a piece of information that is identified during an initial search of the information included in data sources 117. For example, an anonymous post in a chat room does not indicate a name of a venue being patronized by that user but does indicate that a larger than expected number of people have attended a live music concert at the venue. The contents of the post also includes information that indicates the following details about the user that made the post: that they will be attending a live music concert X, they live in neighborhood Y, that they enjoy foods A, B and C that are only served at that venue, and that their favorite color is orange. Using this information, extended safety program 113 compares the details about the user, the live music concert X, and the details about the food being served to the details about venues near neighborhood Y that are included on data sources 117. Based on a result of the comparison, extended safety program 113 identifies a probable identity for the venue being patronized by the user that made the anonymous post, i.e., the probable identity is the derived information. In the event of a hazard being confirmed that affects neighborhood Y, extended safety program 113 predicts that street Z will be overloaded by the volume of individuals leaving live music concert X. As such, in the event of such a hazard being confirmed that affects neighborhood Y, extended safety program 113 does not recommend the use of street Z as a route of egress because street Z passes in front of the venue and extended safety program 113 has predicted that street Z will be overloaded by the volume of individuals leaving live music concert X.

In general, extended safety program 113 derives information by parsing the data retrieved from data sources 117 and retrieving new information from data sources 117 that is related to the parsed data. This new information includes specific data that can be used as variables when determining recommended courses of action. For example, there may be a statistical relationship between two words, synonym A and synonym B, which indicates that they are likely synonyms to one another. The original data retrieved from data sources 117 includes one of those synonyms, for example synonym A. As such, extended safety program 113 conducts a search using synonym B, which is the synonym that was not used in the original search. This second search yields a second collection/aggregate of real-time information that is based on data retrieved from data sources 117. In another example, extended safety program 113 identifies a sub-category of data that includes information regarding a variable identified in process 215. Extended safety program 113 then searches for and retrieves other information included in that sub-category, e.g., a movie theatre would fall under a category of buildings, which could further yield a structural layout for that movie theater. As before, retrieved information is parsed to identify specific types of data that can be used as variables to determine recommended courses of action. In other embodiments, different methods of semantic analysis are applied by extended safety program 113 to search for and derive information based on the data retrieved from data sources 117. It is to be noted that the method used herein is not to be interpreted as a limitation as any number of such methods may be employed in a desired embodiment of the present invention.

In process 330, extended safety program 113 applies the set of rules for the user of mobile device 121 and the users of mobile devices 120 that are in proximity, which were identified in step 310. These rules are included as part of device accounts 119. The rules include a variety of variables based on the specific user for which a recommended course of action will be determined. Extended safety program 113 uses the aggregated real-time information and the derived information to generate a set of possible recommended courses of action for each user and then applies statistical analysis to determine which of possible recommended courses of action will most likely aid the user in avoiding the hazard.

In other words, extended safety program 113 uses the aggregated real-time information and the derived information as variables that are plugged into their corresponding fields that are included in the rules. In some cases, a rule can include a field for a variable that corresponds to, for example, a number, a name, a location, or a threshold. The number of and type of variables utilized by a given rule often vary from one rule to the next. As such, the fields of each rule are filled with the determined variables and the rule is assessed to determine if the rule yields a recommended course of action that will reduce the probability that the user will experience the hazard. In some cases, certain rules only require a single variable to determine that a recommended course of action that will reduce the probability that the user will experience the hazard. In other cases, multiple variables are required by a rule to determine that a recommended course of action will reduce the probability that the user will experience the hazard, sometimes with values in excess of a threshold. The end result of the analysis of the rules is a set of potential courses of action that extended safety program 113 selects from when determining which course of action to recommend to a particular user.

In process 335, extended safety program 113 composes and sends a message to mobile device 121 and mobile devices 120 based on the set of potential courses of action. Based on the set of potential courses of action, extended safety program 113 selects recommended courses of action that will reduce the probability that the users will experience the hazard and sends respective messages to mobile device 121 and mobile devices 120 indicating those actions respectively. The individual messages include a recommended course of action that extended safety program 113 has determined to best match both the user, the environment of the user, and the potential hazard. For example, a confirmed hazard is a fire in building Z. User 1, operating mobile device 121, is in building Z and has difficulty walking due to a broken leg. The medical history and physical limitations of user 1 are included as part of device accounts 119. As such, the rules included in device accounts yield several options for exiting the building. However, only one of those rules, rule 45, takes into account the physical limitations of user 1 when generating a possible course of action. Therefore, extended safety program 113 selects the recommended course of action generated by rule 45 and sends a message to user 1 that includes the recommended course of action generated by rule 45.

In some embodiments, a rule does not exist that generates a course of action that will reduce the probability that the users will experience the hazard. In such situations, extended safety program 113 selects a course of action that will reduce the probability that the users will experience the hazard from additional actions 115. The courses of action included in additional actions 115 are preset and include a variety of actions to cover a wide range of potential emergency situations and hazards.

In some scenarios and embodiments, preset actions are sent to mobile devices 120 based on the confirmation of a hazard. For example, extended safety program 113 confirms that a flash flood has occurred. Extended safety program 113 determines the direction of the flood water and modifies the proximity of mobile device 121 to include mobile devices 120 that were not included in the original proximity. Extended safety program 113 then sends a warning message to the mobile dives 120 in the modified proximity thereby providing the users of those mobile devices 120 with a warning about the flood hazard. In some embodiments, extended safety program 113 sends a follow up recommended course of action based on a further analysis of the user, the location of the user, and the surroundings of the users of mobile devices 120. In continuation with the previous example, extended safety program 113 determines that half of the users of mobile devices 120 are in vehicles and the other half are on foot. Extended safety program 113 sends driving directions to the users of mobile devices 120 that are in vehicles and directions to the nearest safe high ground for the other half of the users that are on foot.

In an embodiment, extended safety program 113 executes a set of actions in response to a type and number of hazards that are determined to exist. In some cases, this is determined by further rules included in device accounts 119. In such situations, certain details may be included in the message sent to mobile device 121 and mobile devices 120, such as a planned destination for the user, the type of hazard deemed to exist, the location of certain individuals (e.g., emergency medical personnel). In other cases, extended safety program 113 contacts another individual, such as a parent or authority figure, and informs them of the hazard. In such cases, the rules included in device accounts 119 indicate who is to be contacted as well as a method of contact that is to be employed, e.g. an automated phone call, a text message, an email etc.

Figure 4:
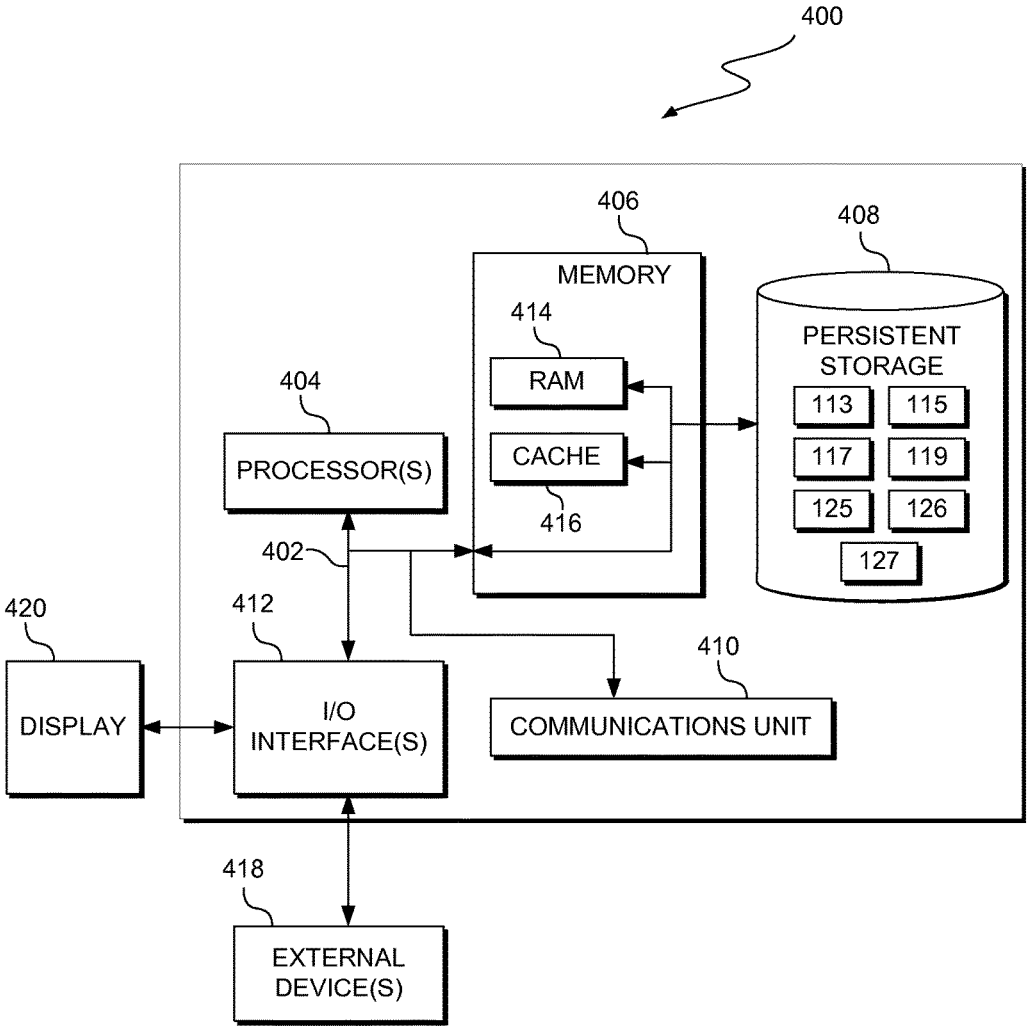
FIG. 4 depicts a block diagram of components of a mobile device executing the personal safety program and the server computing device executing the extended safety program, in accordance with an embodiment of the present invention.

FIG. 4 depicts a block diagram, 400, of mobile device 121 and mobile devices 120, which are respectively executing personal safety program 125, and server computing device 110 executing extended safety program 113, in accordance with an embodiment of the present invention. It should be appreciated that FIG. 4 provides only an illustration of one implementation and does not imply any limitations with regard to the environments in which different embodiments may be implemented. Many modifications to the depicted environment may be made.

Server computing device 110, mobile devices 120 and mobile device 121 respectively include communications fabric 402, which provides communications between computer processor(s) 404, memory 406, persistent storage 408, communications unit 410, and input/output (I/O) interface(s) 412. Communications fabric 402 can be implemented with any architecture designed for passing data and/or control information between processors (such as microprocessors, communications and network processors, etc.), system memory, peripheral devices, and any other hardware components within a system. For example, communications fabric 402 can be implemented with one or more buses.

Memory 406 and persistent storage 408 are computer-readable storage media. In this embodiment, memory 406 includes random access memory (RAM) 414 and cache memory 416. In general, memory 406 can include any suitable volatile or non-volatile computer-readable storage media.

Extended safety program 113, additional actions 115, data sources 117, device accounts 119, personal safety program 125, user profile 126 and sensor data 127 are stored in persistent storage 408 for execution and/or access by one or more of the respective computer processors 404 via one or more memories of memory 406. In this embodiment, persistent storage 408 includes a magnetic hard disk drive. Alternatively, or in addition to a magnetic hard disk drive, persistent storage 408 can include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 408 may also be removable. For example, a removable hard drive may be used for persistent storage 408. Other examples include optical and magnetic disks, thumb drives, and smart cards that are inserted into a drive for transfer onto another computer-readable storage medium that is also part of persistent storage 408.

Communications unit 410, in these examples, provides for communications with other data processing systems or devices, including resources of network 130. In these examples, communications unit 410 includes one or more network interface cards. Communications unit 410 may provide communications through the use of either or both physical and wireless communications links. Extended safety program 113, additional actions 115, data sources 117, device accounts 119, personal safety program 125, user profile 126 and sensor data 127 may be downloaded to persistent storage 408 through communications unit 410.

I/O interface(s) 412 allows for input and output of data with other devices that may be respectively connected to server computing device 110, mobile devices 120 and mobile device 121. For example, I/O interface 412 may provide a connection to external devices 418 such as a keyboard, keypad, a touch screen, and/or some other suitable input device. External devices 418 can also include portable computer-readable storage media such as, for example, thumb drives, portable optical or magnetic disks, and memory cards. Software and data used to practice embodiments of the present invention, e.g., extended safety program 113, additional actions 115, data sources 117, device accounts 119, personal safety program 125, user profile 126 and sensor data 127, can be stored on such portable computer-readable storage media and can be loaded onto persistent storage 408 via I/O interface(s) 412. I/O interface(s) 412 also connect to a display 420.

Display 420 provides a mechanism to display data to a user and may be, for example, a computer monitor, or a television screen.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

It is to be noted that the term(s) "Smalltalk" and the like may be subject to trademark rights in various jurisdictions throughout the world and are used here only in reference to the products or services properly denominated by the marks to the extent that such trademark rights may exist.

What is claimed is:

1. A method to recommend a course of action to a user, the method comprising:

determining, by one or more processors, that a hazard is indicated by a first mobile computing device that is associated with a user;

determining, by the one or more processors, a proximity respective to the first mobile computing device that is based on a type of the hazard;

identifying, by the one or more processors, at least one second mobile computing device that is within the proximity to the first mobile computing device;

sending, by the one or more processors, a query regarding the hazard to the at least one second mobile computing device;

receiving, by the one or more processors, a query response regarding the hazard from the at least one second mobile computing device;

responsive to receiving the query response regarding the hazard, determining, by one or more processors, a course of action, wherein the course of action is configured for one or both of (i) the first mobile computing device and (ii) for the user based, at least in part, on at least one attribute of the user; and sending, by one or more processors, the course of action to the first mobile computing device.

2. The method of claim 1, the method further comprising:

determining, by one or more processors, that the hazard that is indicated by a first mobile computing device likely exists based, at least in part, on details of the hazard that are retrieved from a data store.

3. The method of claim 1, the method further comprising:

determining, by one or more processors, that the hazard that is indicated by a first mobile computing device likely exists based, at least in part, on one or more of a profile of the user, sensor data from one or more sensors of the first mobile computing device, and one or more rules created by the user.

4. The method of claim 3, the method further comprising:

responsive to a signal from the first mobile computing device that indicates that a first level of assessment has determined that the hazard likely exists, initiating, by the one or more processors, a second level of assessment that is configured to confirm whether the hazard exists, wherein the first mobile computing device is configured to (i) perform the first level of assessment to determine whether a hazard likely exists and to (ii) send the signal that initiates the second level of assessment in response to a determination by the first level of assessment that the hazard likely exists.

5. The method of claim 1, wherein determining, by one or more processors, a course of action further comprises:

retrieving, by one or more processors, information from a data store; and determining, by the one or more processors, the course of action by using at least a portion of the information as one or more variables in a rule that dictates, at least in part, a course of action to be recommended to the user, wherein the information includes one or more of (i) an indication of an ability of the user and (ii) a preference stored in a profile of the user.

6. The method of claim 1, the method further comprising:

responsive to a query response regarding the hazard that indicates that the hazard does not exist, configuring, by the one or more processors, the course of action to initiate a calibration of one or more sensors of the first mobile computing device based, at least in part, on a historical record of sensor data that yielded a false positive identification of the hazard.

7. The method of claim 1, the method further comprising:

sending, by one or more processors, a query for data regarding the hazard to the at least one second mobile computing device in response to receiving a signal from the first mobile computing device that indicates the hazard likely exists.

8. A computer program product to recommend a course of action to a user, the computer program product comprising:

one or more computer-readable storage media and program instructions stored on the one or more computer-readable storage media, the program instructions comprising:

program instructions to determine that a hazard is indicated by a first mobile computing device that is associated with a user;

program instructions to determine a proximity respective to the first mobile computing device that is based on a type of the hazard;

program instructions to identify at least one second mobile computing device that is within the proximity to the first mobile computing device;

program instructions to send a query regarding the hazard to the at least one second mobile computing device;

receiving, by the one or more processors, a query response regarding the hazard from the at least one second mobile computing device;

program instructions to respond to receiving the query response regarding the hazard by determining a course of action, wherein the course of action is configured for one or both of (i) the first mobile computing device and (ii) for the user based, at least in part, on at least one attribute of the user; and program instructions to send the course of action to the first mobile computing device.

9. The computer program product of claim 8, the program instructions further comprising:

program instructions to determine that the hazard that is indicated by a first mobile computing device likely exists based, at least in part, on details of the hazard that are retrieved from a data store.

10. The computer program product of claim 8, the program instructions further comprising:

program instructions to determine that the hazard that is indicated by a first mobile computing device likely exists based, at least in part, on one or more of a profile of the user, sensor data from one or more sensors of the first mobile computing device, and one or more rules created by the user.

11. The computer program product of claim 10, the program instructions further comprising:

program instructions to respond to a signal from the first mobile computing device that indicates that a first level of assessment has determined that the hazard likely exists by initiating a second level of assessment that is configured to confirm whether the hazard exists, wherein the first mobile computing device is configured to (i) perform the first level of assessment to determine whether a hazard likely exists and to (ii) send the signal that initiates the second level of assessment in response to a determination by the first level of assessment that indicates that the hazard likely exists.

12. The computer program product of claim 8, wherein program instructions to determine a course of action further comprises:

program instructions to retrieve information from a data store; and program instructions to determine the course of action by using at least a portion of the information as one or more variables in a rule that dictates, at least in part, a course of action to be recommended to the user, wherein the information includes one or more of (i) an indication of an ability of the user and (ii) a preference stored in a profile of the user.

13. The computer program product of claim 8, the program instructions further comprising:

program instructions to respond to a query response regarding the hazard that indicates that the hazard does not exist by configuring the course of action to initiate a calibration of one or more sensors of the first mobile computing device based, at least in part, on a historical record of sensor data that yielded a false positive identification of the hazard.

14. The computer program product of claim 11, the program instructions further comprising:

program instructions to send a query for data regarding the hazard to the at least one second mobile computing device in response to a signal from the first computing mobile device that indicates the hazard likely exists.

15. A computer system to recommend a course of action to a user, the computer system comprising:

one or more computer processors;

one or more computer readable storage medium;

program instructions stored on the computer readable storage medium for execution by at least one of the one or more processors, the program instructions comprising:

program instructions to determine that a hazard is indicated by a first mobile computing device that is associated with a user;

program instructions to determine a proximity respective to the first mobile computing device that is based on a type of the hazard;

program instructions to identify at least one second mobile computing device that is within the proximity to the first mobile computing device;

program instructions to send a query regarding the hazard to the at least one second mobile computing device;

receiving, by the one or more processors, a query response regarding the hazard from the at least one second mobile computing device;

program instructions to respond to receiving the query response regarding the hazard by determining a course of action, wherein the course of action is configured for one or both of (i) the first mobile computing device and (ii) for the user based, at least in part, on at least one attribute of the user; and program instructions to send the course of action to the first mobile computing device.

16. The computer system of claim 15, the program instructions further comprising:

program instructions to determine that the hazard that is indicated by a first mobile computing device likely exists based, at least in part, on details of the hazard that are retrieved from a data store.

17. The computer system of claim 15, the program instructions further comprising:

program instructions to determine that the hazard that is indicated by a first mobile computing device likely exists based, at least in part, on one or more of a profile of the user, sensor data from one or more sensors of the first mobile computing device, and one or more rules created by the user.

18. The computer system of claim 17, the program instructions further comprising:

program instructions to respond to a signal from the first mobile computing device that indicates that a first level of assessment has determined that the hazard likely exists by initiating a second level of assessment that is configured to confirm whether the hazard exists, wherein the first mobile computing device is configured to (i) perform the first level of assessment to determine whether a hazard likely exists and to (ii) send the signal that initiates the second level of assessment in response to a determination by the first level of assessment that indicates that the hazard likely exists.

19. The computer system of claim 15, wherein program instructions to determine a course of action further comprises:

program instructions to retrieve information from a data store; and program instructions to determine the course of action by using at least a portion of the information as one or more variables in a rule that dictates, at least in part, a course of action to be recommended to the user, wherein the information includes one or more of (i) an indication of an ability of the user and (ii) a preference stored in a profile of the user.

20. The computer system of claim 15, the program instructions further comprising:

program instructions to respond to a query response regarding the hazard that indicates that the hazard does not exist by configuring the course of action to initiate a calibration of one or more sensors of the first mobile computing device based, at least in part, on a historical record of sensor data that yielded a false positive identification of the hazard.

* * * * *